US010026527B2

(12) United States Patent
Schwarzer et al.

(10) Patent No.: US 10,026,527 B2
(45) Date of Patent: Jul. 17, 2018

(54) CONDUCTOR TWISTING SYSTEM AND METHOD FOR LOADING A TWISTING HEAD

(71) Applicant: Lisa Draexlmaier GmbH, Vilsbiburg (DE)

(72) Inventors: Roland Schwarzer, Eichendorf (DE); Konrad Gruber, Rott am Inn (DE); Juergen Herzig, Bodenkirchen (DE); Ralf Kasper, Grafing (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/597,592

(22) Filed: May 17, 2017

(65) Prior Publication Data

US 2017/0338011 A1 Nov. 23, 2017

(30) Foreign Application Priority Data

May 18, 2016 (DE) ..... 10 2016 109 155

(51) Int. Cl.
*H01B 13/02* (2006.01)

(52) U.S. Cl.
CPC ..... *H01B 13/0228* (2013.01)

(58) Field of Classification Search
CPC . H01B 13/02; H01B 13/0207; H01B 13/0228
See application file for complete search history.

(56) References Cited

U.S. PATENT DOCUMENTS 5,412,855 A * 5/1995 Koch ..... H01R 43/052 29/33 M
5,709,347 A * 1/1998 Hoffmann ..... B65H 59/04 192/69.42
6,167,919 B1 1/2001 Fuchsl et al.
(Continued)

FOREIGN PATENT DOCUMENTS

CN 103038836 A 4/2013
CN 104143394 A 11/2014
(Continued)

OTHER PUBLICATIONS

German Office Action dated Feb. 28, 2017, 12 pages.
(Continued)

*Primary Examiner* — Shaun R Hurley
(74) *Attorney, Agent, or Firm* — Finnegan, Henderson, Farabow, Garrett & Dunner, LLP

(57) ABSTRACT

The present disclosure relates to a twisting system for twisting multiple conductors together. In one implementation, the twisting system may include a rotatable twisting head having multiple holders for individual conductors of a cable to be twisted, and a loading device for sequentially loading the holders with the individual conductors. The loading device may be configured to be displaced into a transfer position identical for all individual conductors for loading the twisting head, and the twisting head may be configured to rotate a free holder of the twisting head into a suitable receiving position for being loaded with an individual conductor. The present disclosure also relates to a method for loading a twisting head with individual conductors.

19 Claims, 9 Drawing Sheets

(56) References Cited

U.S. PATENT DOCUMENTS

| | | | | |
|---|---|---|---|---|
| 7,637,005 | B2 * | 12/2009 | Lustenberger | H01R 43/048 29/33 F |
| 7,647,759 | B2 * | 1/2010 | Braun | H01R 43/28 57/1 UN |
| 9,132,985 | B2 * | 9/2015 | Wortmann | H01B 13/0003 |
| 9,416,488 | B2 * | 8/2016 | Stier | D07B 3/04 |
| 9,624,607 | B2 | 4/2017 | Keil | |
| 2009/0241314 | A1 * | 10/2009 | Watanabe | H01B 13/0271 29/33 F |
| 2014/0331636 | A1 | 11/2014 | Keil | |
| 2015/0101700 | A1 | 4/2015 | Stier et al. | |

FOREIGN PATENT DOCUMENTS

| | | | |
|---|---|---|---|
| CN | 105427960 | A | 3/2016 |
| CN | 105551689 | A | 5/2016 |
| CN | 105552680 | A | 5/2016 |
| DE | 298 21 664 | U1 | 1/2000 |
| DE | 101 07 670 | B4 | 11/2005 |
| DE | 20 2009 004 913 | U1 | 7/2010 |
| DE | 20 2009 004 914 | U1 | 7/2010 |
| DE | 20 2010 001 324 | U1 | 9/2010 |
| DE | 20 2011 051 942 | U1 | 11/2012 |
| EP | 0 889 486 | B1 | 1/1999 |
| EP | 0 917 746 | B1 | 12/2000 |
| EP | 1 032 095 | B1 | 5/2013 |
| EP | 2 801 984 | A1 | 11/2014 |
| EP | 2 777 053 | B1 | 12/2015 |
| EP | 3 012 841 | A1 | 4/2016 |
| WO | WO 2012/015057 | A2 | 2/2012 |
| WO | WO 2015/126323 | A1 | 8/2015 |

OTHER PUBLICATIONS

Office Action in German Application No. DE 10 2016 109 155.3, dated Feb. 28, 2017.

Decision to Grant in German Application No. DE 10 2016 109 155.3, dated Apr. 20, 2017.

* cited by examiner

CONDUCTOR TWISTING SYSTEM AND METHOD FOR LOADING A TWISTING HEAD

TECHNICAL FIELD

The present disclosure relates to a twisting system, comprising a rotatable twisting head having multiple holders for individual conductors of a cable to be twisted, and a loading device for sequentially loading the holders with the individual conductors. The present disclosure also relates to a tandem twisting system comprising two juxtaposed individual twisting systems. The present disclosure further relates to a method for loading a twisting head with individual conductors. Embodiments of the present disclosure may, in particular, be applied to a creation of cables for vehicles.

BACKGROUND

DE 298 21 664 U1 generally relates to a device for twisting conductors, comprising a frame on which a mount for clampingly receiving the conductor ends is disposed at each end, whereby a twisting section is formed between the mounts, and wherein one of the mounts can be rotatably driven by a drive, and the opposite second mount is disposed on a carriage, wherein the mounts comprise a clamping lever, which presses the cables against a stop, for manually clamping the wires.

EP 2 777 053 B1 generally relates to a twisting device for twisting electrical or optical lines such as wires, cables, wiring bundles, optical fibers and the like, in particular a cable twisting device, comprising a base and a first twisting head, which can be rotated relative to the base and is designed to grip the conductors to be twisted at the first ends thereof, wherein the twisting device comprises a second twisting head, which can be rotated relative to the base and which is arranged opposite the first twisting head and designed to grip the conductors to be twisted at the second ends thereof located opposite the first ends, and the second twisting head can be rotated in a direction that is opposite that of the first twisting head.

EP 0 889 486 B1 generally relates to a production unit for a twisted cable and/or for twisted wires, comprising parallel arrangements of a plurality of opposed or opposite pairs of cable clamps, providing clamps on one side for clamping one end of a pair of cables having a defined length and clamps on the other side for clamping the other end of the pair of cables, wherein each cable pair extends in a substantially longitudinal direction between a corresponding pair of cable clamps, wherein one cable clamp of each pair is driven in rotation by a drive unit, and the other cable clamp of each pair is fixed or secured, whereby relative twisting rotational movements are imparted to both cables, furthermore comprising: a forward movement mechanism, which is provided for intermittently advancing each corresponding pair of cable clamps in a direction transverse to the substantially longitudinal direction.

EP 0 917 746 B1 generally relates to methods for twisting at least two individual conductors, comprising the following steps: clamping the one conductor ends of individual conductors, which have been cut to a particular length, in respective separate untwisting tensioning holders which can be rotated substantially parallel to a twisting axis; clamping the other conductor ends of the individual conductors in respective separate twisting tensioning holders, which are arranged so as to be jointly rotatable about the twisting axis; arranging a twisting slide between the substantially tensioned conductors; and rotating the twisting tensioning holders jointly about the twisting axis and rotating each of the untwisting tensioning holders about the conductor axis of the respective individual conductors in the same direction.

DE 20 2009 004 913 U1 generally relates to a device for twisting conductors, comprising a frame having opposing mounts for clampingly receiving the conductors to be twisted, whereby a twisting section is formed between the mounts, wherein one of the mounts on the frame can be rotatably driven by a drive, and wherein the second opposing mount is disposed on the frame displaceably on a carriage, wherein the free ends of the conductors to be twisted are arranged on the mounts distributed on a circle or circular segment, wherein one of the mounts is held under tensile stress resulting in at least almost identical positions of the conductors with respect to the rotational axis.

DE 20 2009 004 914 U1 generally relates to a device for twisting conductors, comprising a frame having opposing mounts for clampingly receiving the conductors to be twisted, whereby a twisting section is formed between the mounts, wherein one of the mounts on the frame can be rotatably driven by a drive, and wherein the second opposing mount is arranged on the frame displaceably on a carriage, wherein the device is intended to manually handle at least two conductors which, at the free ends thereof, are each arranged under tensile stress on the mounts, and one of the mounts is held under tensile stress for orienting the conductors with respect to one another, wherein the device comprises a path length measuring system for exactly determining the twisting section, which provides the measurement result in a form that a control unit is able to evaluate.

DE 20 2010 001 324 U1 generally relates to a device for twisting conductors, comprising a frame having opposing tensioning devices for clampingly receiving the conductors to be twisted, whereby a twisting section is formed between the tensioning devices, with at least one tensioning device on the frame being rotatably drivable by a drive, and the second opposing tensioning device being arranged on the frame displaceably on a carriage, characterized in that at least one of the tensioning devices provided for the twisting operation is assigned a holding device, which is connected to a feed unit and in which the conductors to be twisted can be clamped by the operator even while the twisting operation is ongoing, and which automatically transfers the clamped conductors to the tensioning device after the twisting operation has been carried out.

DE 20 2011 051 942 U1 generally relates to a device for twisting conductors, comprising a frame having opposing tensioning devices for clampingly receiving the conductors to be twisted, whereby a twisting section is formed between the tensioning devices, with at least one tensioning device on the frame being rotatably drivable by a drive, and the tensioning device situated opposite the drive being arranged on a carriage so as to be displaceable along the twisting section, characterized in that at least one of the tensioning devices provided for the twisting operation is assigned at least one further tensioning device for providing at least two operating positions, which can be changed by means of a changing device, so that the operator can clamp new conductors to be twisted into the further second tensioning device even while the twisting operation of the tensioning devices is ongoing.

DE 101 07 670 B4 generally relates to a method for twisting at least two individual conductors to form a twisted cable harness, comprising the following steps: a) guiding the one conductor ends of individual conductors through associated tensioning clamps in a cable holder head, b) fixing the conductor ends guided through the tensioning clamps in respective tensioning jaws in a twisting head, c) applying a holding pressure to the tensioning clamps in the cable holder head, which allows the individual conductors to be pulled through the tensioning clamps under friction so that the individual conductors are always tautly stretched, d) displacing the twisting head, while maintaining the holding pressure, until the individual conductors have been tensioned to the desired length, e) twisting the twisting head during method step d) by a predetermined number of revolutions, f) applying a fixing pressure to the tensioning clamps in the cable holder head, which is higher than the holding pressure, so that secure clamping of the individual conductors during the subsequent twisting operation is ensured, and g) twisting the individual conductors, which are now fixed on both sides, to form a twisted cable harness.

EP 1 032 095 B1 generally relates to a method for processing two conductors and for twisting the two conductors to form a conductor pair in a device, wherein the two conductors are stretched, clamped at both ends and twisted from one end of the two conductors to form the conductor pair, wherein multiple conductor pairs can be processed simultaneously in the device, wherein each conductor pair is subjected to the following work steps carried out consecutively by the device: processing the conductor ends of a leading end of a first conductor pair in a device for processing and loading leading conductor ends; processing the conductor ends of a trailing end of the first conductor pair in a device for processing and loading trailing conductor ends; and twisting the two conductors of the first conductor pair in a twisting device, characterized in that: the leading conductor ends are provided to a displaceable receiving module and transferred to the twisting device; the trailing conductor ends are provided to a transfer module and transferred to a holding module, wherein, during the loading of the trailing conductor ends of the conductors of the first conductor pair, the leading conductor ends of the two conductors of a second conductor pair are processed in the same unit.

EP 2 801 984 A1 generally relates to a gripper for electrical or optical lines (such as wires, cables, wiring bundles, optical fibers), which comprises two gripper jaws that can be moved relative to an abutment by means of a drive system and relative to one another. Twisting heads for the aforementioned conductors are typically equipped with such grippers. The gripper, and thus also the twisting head and the twisting device, are provided with a drive system, which comprises at least one drive that has an adjustable force and, via a link chain, acts on each gripper jaw.

EP 3 012 841 A1 generally relates to a device for feeding conductor ends to a twisting device comprising a rotatable twisting head and multiple holders for simultaneously loading individual conductors of a cable to be twisted. WO 2015/126 323 A1 generally relates to a twisting machine comprising two rotatable twisting heads, which can rotate in opposite directions.

DESCRIPTION

Disclosed embodiments may overcome the disadvantages of the state of the art at least partially, and may provide an improved option for twisting individual conductors to form a cable. In particular, disclosed embodiments may provide an easily implementable option for flexibly loading a twisting head with individual conductors.

Embodiments of the present disclosure may include a twisting system, comprising a rotatable twisting head having multiple holders for individual conductors of a cable to be twisted, and a loading device for sequentially loading the holders with the individual conductors, wherein the loading device is configured to be displaced into a transfer position, which is identical for all individual conductors, for loading the twisting head, and the twisting head is configured to rotate a free holder of the twisting head to a suitable receiving position for loading the holder with an individual conductor.

Such embodiments may allow the loading device to have a particularly simple and robust design since it is always displaced into the same transfer position for loading. Additionally, due to the sequential loading of the twisting head, loading parameters, such as a length of the end section of the individual conductor introduced into the twisting head and the like, may be individually set, allowing particularly flexible loading.

A transfer position of the loading device shall, in particular, be understood to mean the position of the loading device that can be assumed to load a free holder of the twisting head with the individual conductor. A receiving position of a holder may be understood to mean the position of the holder at which loading the same with the individual conductor is possible, or can be carried out, by means of the loading device located in the transfer position.

A loading device being "configured to be displaced into the transfer position" (which is identical for all individual conductors) may be understood to mean that the loading device can be accordingly displaced, and that the loading device, for loading, carries out such a displacement movement, for example, in that the device, or a corresponding control unit of the device, is appropriately programmed.

Analogously, a twisting head being "configured to rotate the free holder of the twisting head into a suitable receiving position" may be understood to mean that the free holder of the twisting head can be rotated into the receiving position, and that the twisting head, for receiving purposes or for loading the same, carries out such a rotational movement, for example, in that the head or the drive thereof or a control unit thereof, is appropriately programmed.

In some embodiments, the twisting unit may be displaced into a receiving position, which is identical for all individual conductors, for loading the twisting head thereof. The receiving position of the holder suitable for loading is then composed of the suitable position of the twisting unit and the suitable angular or rotational position of the twisting head.

According to one aspect, the twisting head comprises more than two holders. For example, it can comprise an even number of holders, e.g., four, six holders and the like. However, the twisting head may also comprise an odd number of holders, such as three, five holders and the like. The holders may be arranged rotation-symmetrically about a rotational axis of the twisting head. According to yet another aspect, the twisting head may be rotated in the manner of a turret for being loaded with the individual conductors.

The functional units of the twisting system (twisting unit, untwisting unit, draw-in unit, clamping unit, lay positioning unit and the like) may be integrated or may be designed as modules for particularly easy replaceability and conversion.

According to one embodiment, the twisting system additionally comprises a rotatable untwisting head having multiple holders for individual conductors of a cable to be twisted. In such an embodiment, the loading device is configured to be displaced into a further transfer position, which is identical for all individual conductors, for loading the untwisting head. Further, in such an embodiment, the untwisting head is configured to rotate a free holder of the untwisting head into a suitable receiving position for being loaded with an individual conductor. In this way, analogously easily implementable and flexible loading of an untwisting head may be achieved. The untwisting head may be designed analogously to the twisting head, for example, by comprising more than two holders, having a turret-like rotation for individually receiving the individual conductors, and the like.

According to yet another embodiment, the loading device may be configured to handle individual conductors cut to a predefined length on both sides, and to displace the two ends thereof simultaneously to the twisting head or the untwisting head. In this way, the two ends may be flexibly introduced into the respective holders. The cut-to-length or custom-made individual conductors may be provided directly by one or more upstream customization devices or by one or more upstream magazines including ready-made conductors.

According to a further embodiment, the loading device may be configured to handle individual conductors on one side, and to displace the associated end to the twisting head. In such an embodiment, the individual conductors may be clamped at the end thereof situated opposite the twisting head into a non-rotatable clamping unit. In such an embodiment, the twisting head may initially be loaded with individual conductors, then may pull the individual conductors through the clamping unit (for example in that the twisting head is displaced away from the clamping unit), and then may carry out the twisting operation by means of rotation. In this embodiment, the individual conductors thus only have to be loaded on one side.

According to yet another embodiment, the individual conductors can be introduced into the holders to varying depths. This may allow individual conductors of different length to be introduced into the holders. In this way, for example, conductor ends of the twisted cable can be deliberately arranged longitudinally offset from one another, which simplifies the contacting thereof. Furthermore, this also allows different non-twisted lengths to be implemented.

According to a further embodiment, the loading device may comprise a cross slide table for displacing at least one gripper. Cross slide tables are generally robust and may allow very precise positioning in a, typically horizontal, (x,y) plane. The cross slide table may comprise at least one slide rail extending in an x direction (for example, parallel to a twisting or rotational axis of the cable) (a "longitudinal rail") and at least one slide rail extending perpendicularly thereto in a y direction (a "transverse rail"). For example, the at least one longitudinal rail may be stationary, while the at least one transverse rail may be displaced thereon (in the x direction). For example, the gripper itself can be displaced along the transverse rail. Moreover, the gripper may grip and release an individual conductor. This may take place fully automatically or with manual assistance.

According to yet another embodiment, at least the twisting head (and, in certain aspects, also the untwisting head) comprises at least two gripper jaws, which can be moved relative to an abutment and form a respective holder between each other, wherein the gripper jaws can be pressed against the abutment independently of one another for fixing an associated individual conductor. In this way, individual conductors may be fed at least to the twisting head in a simple manner and held therein. After the twisting operation, the individual conductors may be easily released automatically by removing the gripper jaws from the abutment. In other embodiments, the twisting head and/or the untwisting head may also comprise other mechanisms configured to hold and fix the individual conductors introduced into the holders. For example, clamping jaws that open when pushed out and close when pulled back may be used.

Embodiments of the present disclosure may further include a tandem twisting system comprising two juxtaposed individual twisting systems as described above, wherein a loading device shared by both is arranged between the twisting systems. The tandem twisting system may comprise, in particular, two twisting systems that can be operated, monitored and activated independently of one another and may comprise a centrally located loading device configured to alternately load at least the twisting heads of the respective twisting systems with individual conductors. The loading device may be used together with the left or with the right twisting system, for example, by a displacement to the left or right. This may allow manufacturing variants for the concurrent production of identical or different items to be twisted (in particular cables) on a tandem twisting system. In a first example, an order can be executed on both twisting systems. In this example, the order volume is divided among the two twisting systems. In a second example, a first order is executed on one of the twisting systems and, so as to better utilize the tandem twisting system, concurrently a second order is executed on the other twisting system. Identical or different functional units may be used for this purpose, for example, different variants of twisting heads. By way of further example, one order can be executed on one of the twisting systems using a quadruple twisting head and a conductor clamping unit (for example, a tensioning clamping unit comprising at least four tensioning clamps, which can also be used as a draw-in unit), while another order can be executed on the other twisting system using a double twisting head comprising a lay positioning unit and an untwisting unit. In this example, the tandem twisting unit thus allows one order (same product) to be executed on a twisting unit, the concurrent execution of one order (same product) on both twisting units, or the concurrent execution of different orders (different products) on the tandem twisting unit, the twisting systems being selectively occupied by the corresponding order.

According to a further aspect, different functional units (twisting heads, untwisting units, draw-in units, clamping units and the like) may have a modular design.

Embodiments of the present disclosure may further include a method for loading a twisting head with individual conductors, comprising placing an individual conductor into a transfer position with a loading device; introducing said individual conductor into a free holder of a twisting head located in a suitable receiving position; rotating a twisting head such that a further free holder is brought into the receiving position; placing a second individual conductor into the same transfer position with the loading device; and introducing the second individual conductor into the free further holder of the twisting head.

The method may result in the same advantages as the twisting system and may have an analogous design.

For example, an untwisting unit may be analogously loaded.

The order of the steps may be modified. For example, rotating the twisting head and placing the second individual conductor into the same transfer position may be carried out in any arbitrary order or simultaneously.

In some embodiments, the holder may be located in the receiving position while the twisting unit, together with the associated twisting head, is located in an appropriate receiving position (for example, in a predefined x-y position) and while the twisting head is located in an appropriate transfer angular position.

The properties, features and advantages of the present embodiments as described above, and the manner in which these are achieved, are further set forth in the following schematic description of one exemplary embodiment, which will be described in more detail in connection with the drawings.

BRIEF DESCRIPTION OF DRAWINGS

FIG. 1 shows a tandem twisting system T1 having no shared loading device, with an operator B. The tandem twisting system T1 comprises two individual twisting systems 1*a* and 1*b* having laterally reversed designs. Each of the two twisting systems 1*a*, 1*b* comprises a conductor feed unit 2 having multiple (four as depicted in FIG. 1) conductor channels, by means of which, for example, ready-made or cut-to-length individual conductors L1, L2 can be transported to a tensioning clamping unit 3 comprising respective tensioning clamps. The tensioning clamping unit 3 can also serve as a draw-in unit. Subsequently, the individual conductors L1, L2 are inserted by the operator B into the tensioning clamping unit 3 and furthermore clamped into a twisting head 4 of a twisting unit 5. The twisting unit 5 is shown without a drive in FIG. 1.

FIG. 2 shows a section of the tandem twisting system T1 without the conductor feed unit 2 for the right twisting system 1*b*, and thus provides a view of the right twisting system 1*b*.

Figure 1:
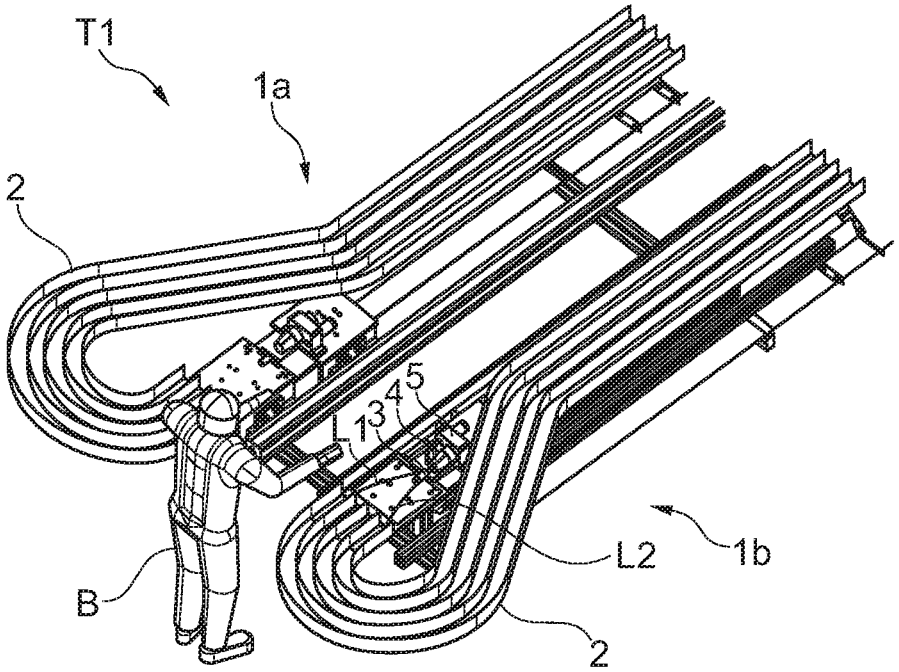
FIG. 1 shows a view from obliquely above onto a tandem twisting system according to a first exemplary embodiment, still without a shared loading device, with an operator.
Figure 2:
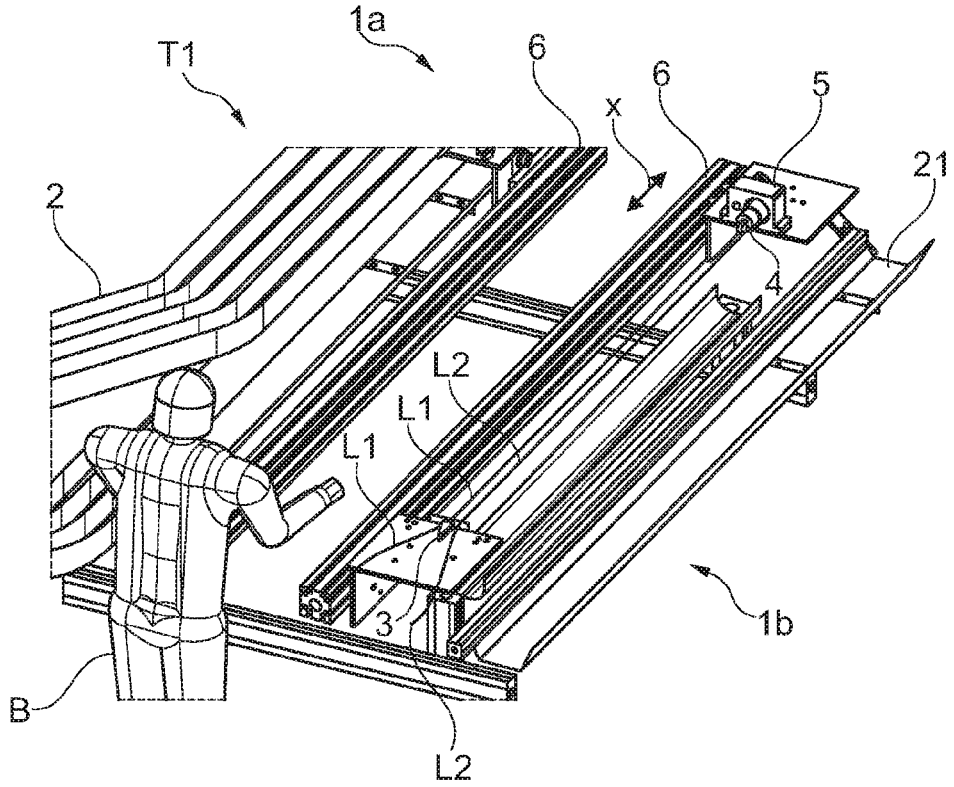
FIG. 2 shows a view from obliquely above onto a section of the tandem twisting system from FIG. 1, with conductor feed units removed from one of the twisting systems.

As depicted in FIG. 2, the twisting unit 5 has been displaced away from the tensioning clamping unit 3 along an x-direction, as indicated by the double arrow x. The x-direction corresponds to or is parallel to a rotational axis of the twisting head 4. For this purpose, the twisting unit 5 can be displaced in a slide rail 6 (for example, using rollers). In the shown twisting position of the twisting head 4, the individual conductors L1 and L2 are tensioned and can be twisted with one another by a rotation of the twisting head 4. Thereafter, the finished twisted cable is released by the operator from the twisting head 4 and from the tensioning clamping unit 3, if necessary after being tied off or the like, and can drop into a collection pan 21.

Figure 3:
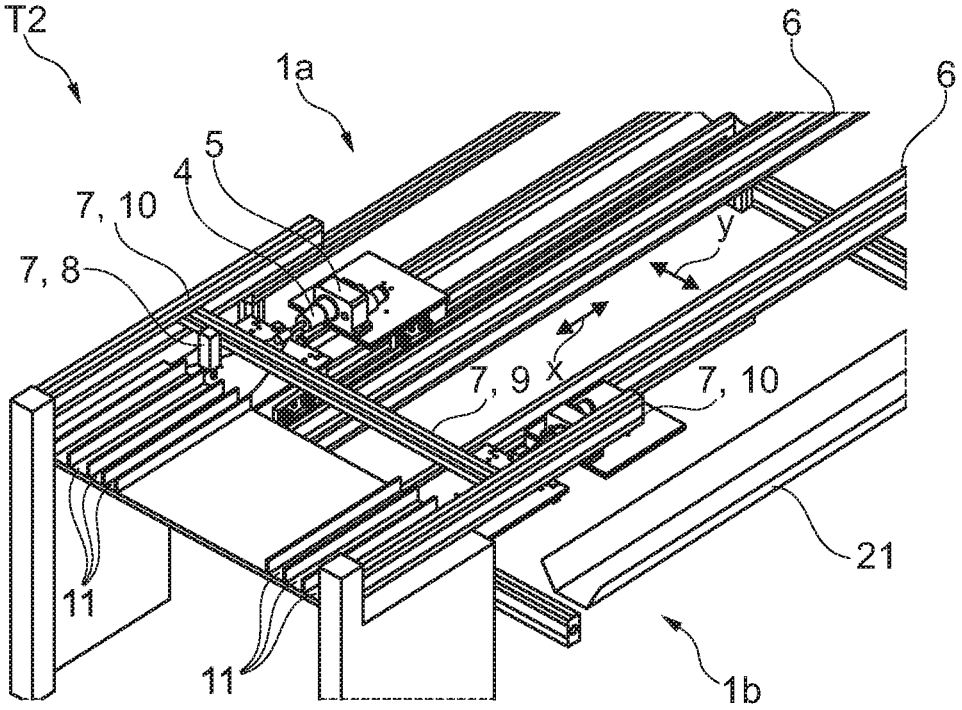
FIG. 3 shows a view from obliquely above onto a section of a tandem twisting system according to a second exemplary embodiment, comprising two twisting units and a centrally arranged shared loading device.

FIG. 3 shows a a tandem twisting system T2, which has a design similar to the tandem twisting system T1, but additionally comprises a loading device 7 arranged centrally between the two twisting systems 1*a* and 1*b*. The conductor feed units 2 are not shown, but may be included. Other functional units, such as a conductor magazine, a conductor cutting machine and the like, may also be included, but are not shown.

The loading device 7 comprises a gripper 8, which can grip the ends of the provided individual conductors L1, L2. The gripper 8 can be displaced in a transverse rail 9 in a y-direction (as indicated by the double arrow y). The transverse rail 9 is introduced at the ends into two longitudinal rails 10 and can be displaced along these longitudinal rails 10 in the x-direction. The transverse rail 9 and the longitudinal rails 10 form a cross slide table 9, 10 for the gripper 8. The longitudinal rails 10 are arranged laterally outside the twisting units 5, so that the gripper 8 can be displaced in the y-direction in front of the twisting heads 4. The longitudinal rails 10 are of sufficient length that the grippers 8 can be moved in the x-direction close to the twisting heads 4 arranged in the receiving position thereof (as shown based on the twisting system 1*a*) and make contact with these.

The gripper 8 can handle a single individual conductor L1, L2 by gripping the same in the region of one end from an associated feed channel 11 (which can adjoin a channel of the conductor feed unit 2) and displacing it into a transfer position by means of the cross slide table 9, 10. There, the twisting head 4 is located in the planar receiving position thereof (which is to say in a position having predefined (x,y) coordinates). A free holder of the twisting head 4 has previously been rotated into a receiving angular position. In the transfer position, the gripper 8 inserts one end of the individual conductor L1, L2 into the free holder of the twisting head 4, as is shown in greater detail in FIG. 4. The twisting head 4 then clamps the individual conductor L1, L2 into the holder 12 for twisting. The twisting head 4 may be displaced from the receiving position into a twisting position, or the receiving position may already correspond to the twisting position.

If yet another individual conductor L1, L2 is to be twisted, the gripper 8 moves back to an individual conductor L1, L2 to be subsequently transferred (which, for this purpose, is located in another of the feed channels 11), and grips the same. As before, the gripper 8 is displaced into the same transfer position and there, or from there, inserts one end of this further individual conductor L1, L2 into a further free holder of the twisting head 4.

Figure 4:
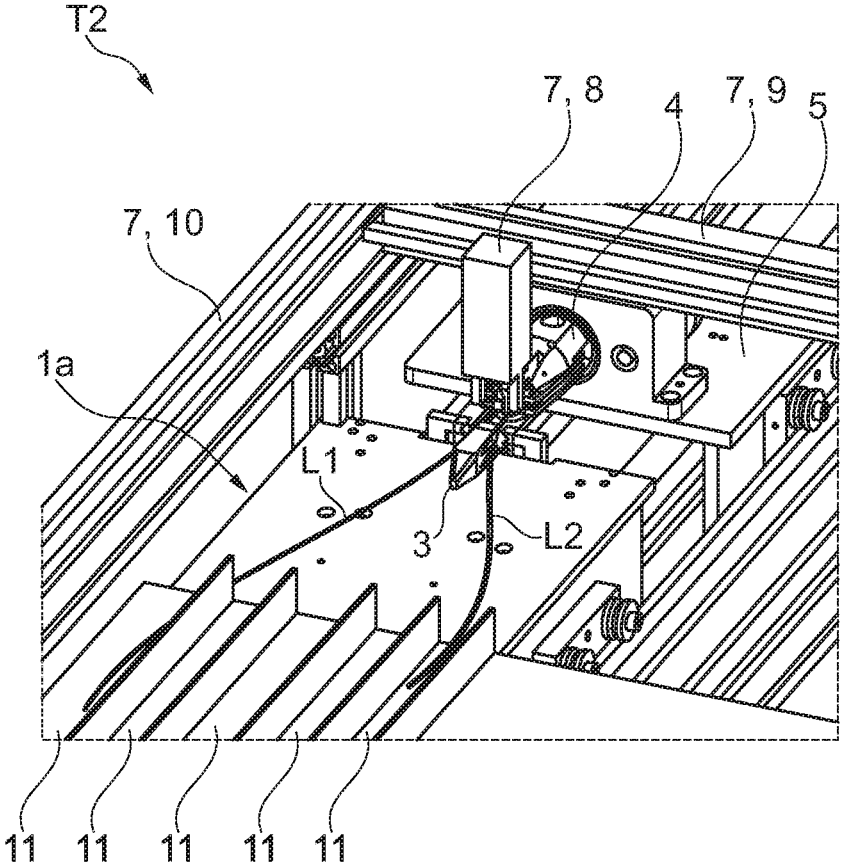
FIG. 4 shows a view from obliquely above onto a section of the tandem twisting system according to the second exemplary embodiment, including the loading device on one of the twisting systems.

As depicted in FIG. 4, the twisting head 4 has been appropriately rotated further so as to provide the further free holder in the same receiving position as the previously loaded holder. The twisting head 4 thus can be rotated in a turret-like manner. This yields the advantage that the gripper 8, at all times, only has to move into the same transfer position for loading or transferring multiple individual conductors L1, L2. This can be repeated until all individual conductors used for twisting (here, for example, all two, three or four individual conductors) have been introduced into the twisting head 4.

Figure 5:
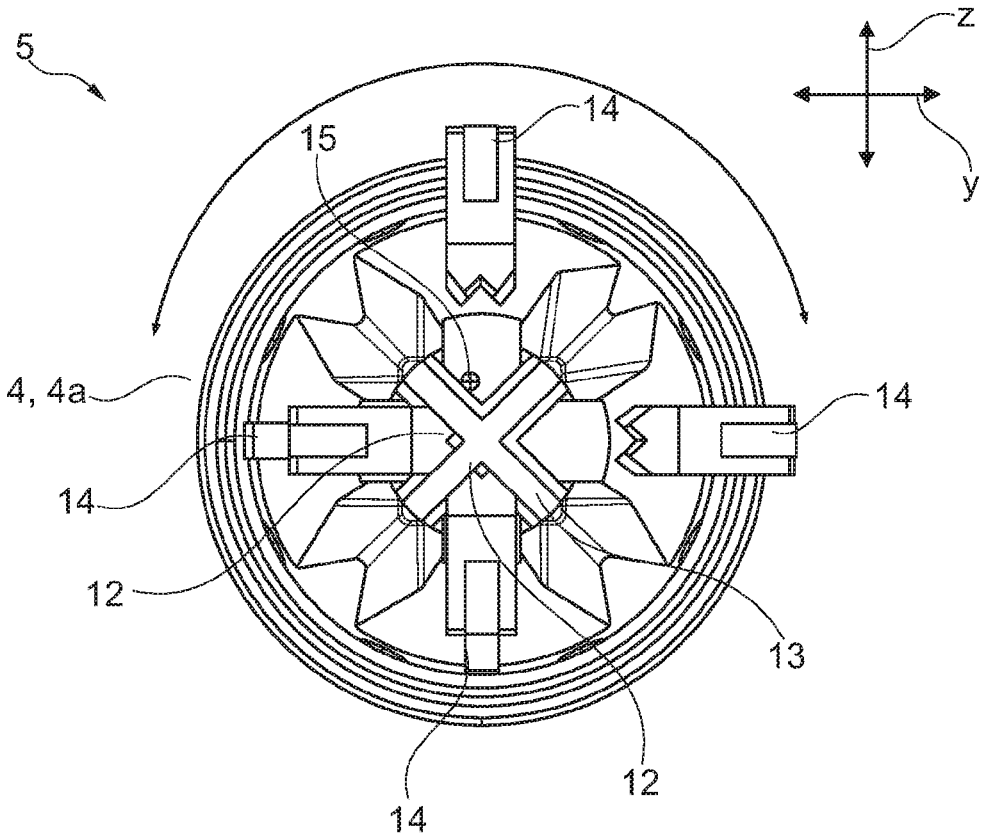
FIG. 5 shows a frontal view of a twisting unit comprising a first twisting head.

FIG. 5 shows a front view of the twisting unit 5 comprising a possible twisting head 4, 4*a* in greater detail. The twisting head 4*a* comprises four holders 12 for receiving a maximum of four individual conductors. Each of the holders 12 is formed by a v-shaped region of a central abutment 13, onto which respective clamping jaws 14 can be individually placed and thereby press and clamp a respective individual conductor on the abutment 13. The lower and the left clamping jaws 14 are shown in the clamped position in FIG. 5, while the upper and the right clamping jaws 14 are shown in an open position ready for loading.

The central abutment 13 is designed in the form of a saltire in the front view. The transfer position 15 of the gripper 8 (indicated by the sun cross) is located in the same (x,z) position as the upper holder 12 located in the receiving position. Thus, the individual conductor held by the gripper 8 (not shown) is located in the transfer position 15. For loading, the associated upper clamping jaw 14 is open and closes when the individual conductor has been introduced.

After being loaded with an individual conductor, the twisting head 4 is rotated by 90°, so that a further individual conductor can be introduced into a further holder 12.

In general, the twisting head, such as the shown twisting head 4, 4*a*, may also be displaced in a z-direction. Likewise, the gripper, such as the gripper 8, may, in general, also be displaced in a z-direction.

Figure 6:
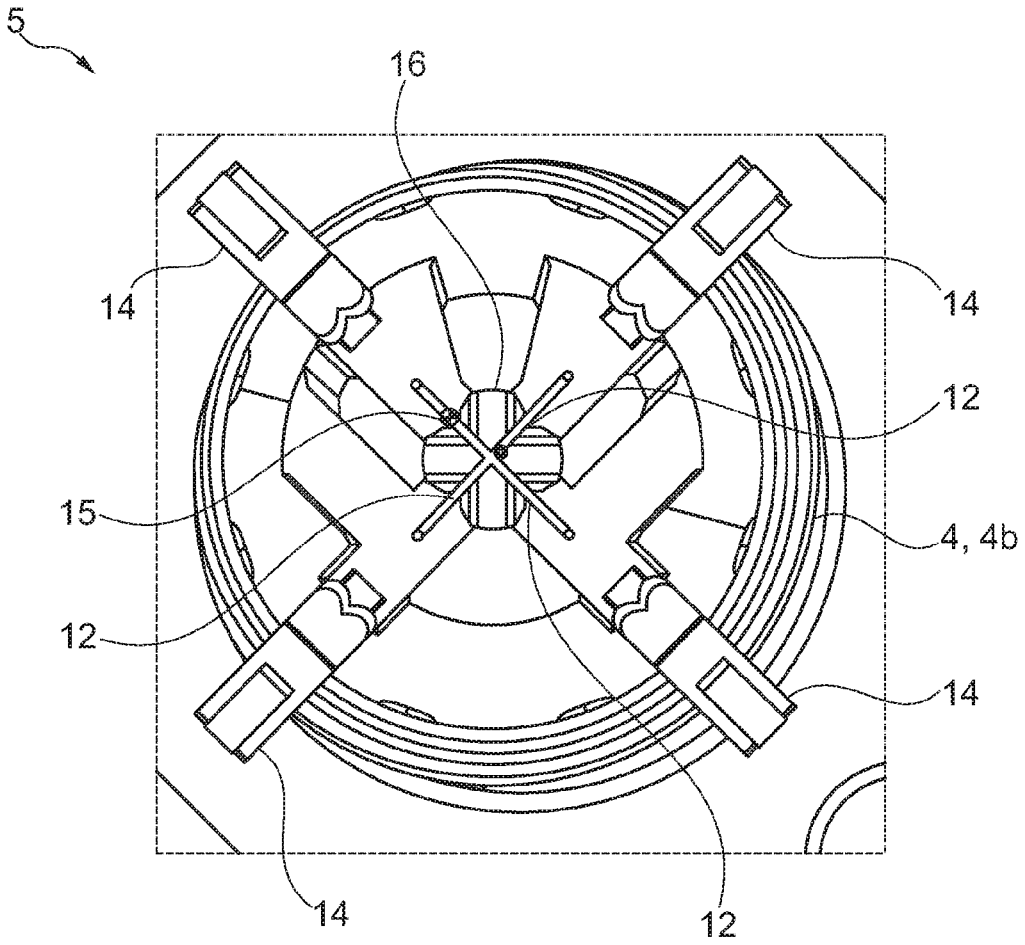
FIG. 6 shows a view obliquely from the front of a twisting unit comprising a second twisting head.

FIG. 6 shows a front view of the twisting unit 5 comprising a further possible twisting head 4, 4*b* in greater detail. The twisting head 4*b* is designed similarly to the twisting head 4*a*, but here comprises a central abutment 16 in the form of a vertical cross. All clamping jaws 14 are shown in the open position thereof.

Figure 7:
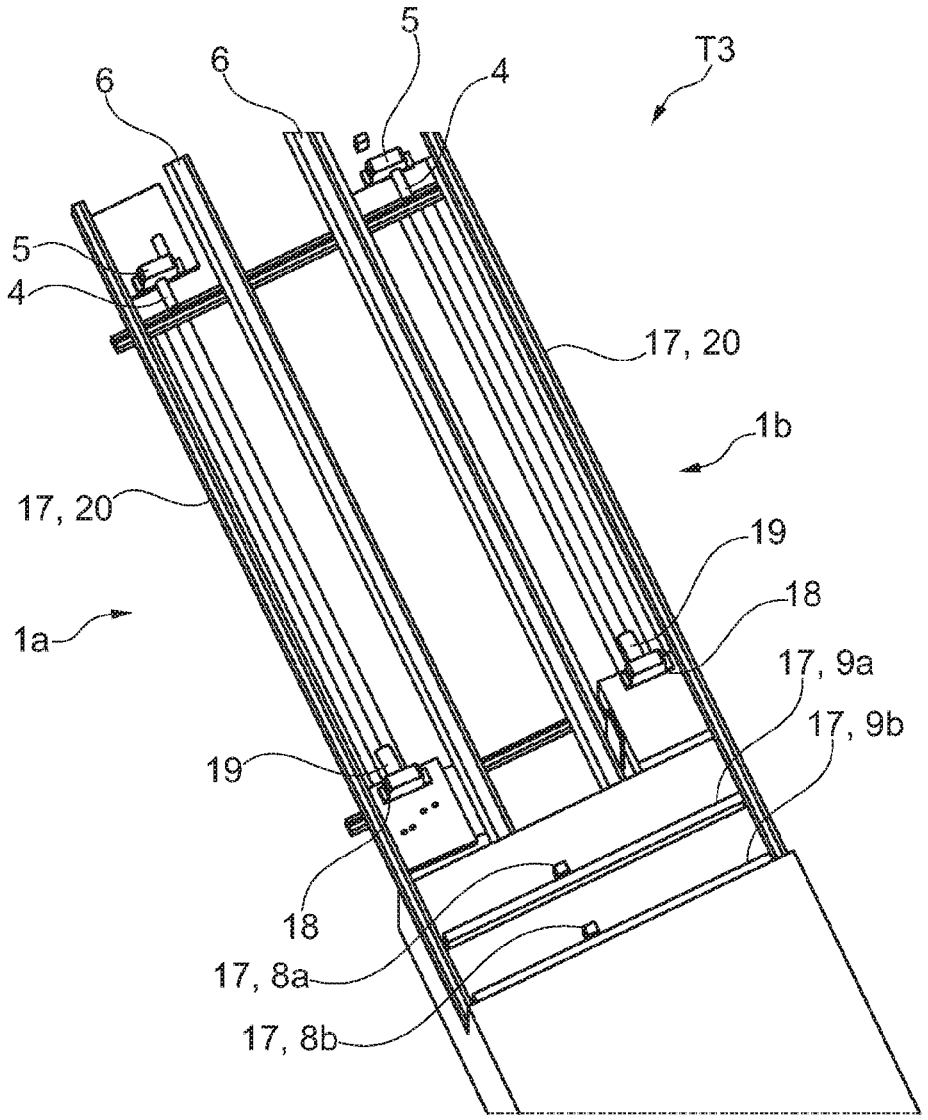
FIG. 7 shows a view from obliquely above onto a section of a tandem twisting system according to a third exemplary embodiment, including a shared loading device in a first position.

FIG. 7 shows a section of a tandem twisting system T3, comprising a loading device 17 between the two individual twisting systems 1*a* and 1*b*.

As depicted in FIG. 7, the two twisting systems 1*a* and 1*b* include a respective untwisting unit 18 comprising an untwisting head 19. At least the untwisting head 19 and the tensioning clamping unit 3, and, in certain aspects, also the twisting head 4, may have modular designs and be easy to attach and remove using standardized interfaces.

The untwisting head 19 likewise comprises four holders (not shown), which are to be loaded with respective individual conductors (not shown). The individual conductors are cut to length introduced into a holder 12 of the twisting head 4 on the one hand, and into a holder of the untwisting head 19 on the other hand.

To facilitate this two-sided loading, the loading device 17 comprises two grippers 8, 8*a* and 8, 8*b*, which can be displaced in the y-direction on respective transverse rails 9, 9*a* and 9, 9*b*. Both transverse rails 9*a* and 9*b* can be displaced in the x-direction on stationary longitudinal rails 20. The longitudinal rails 20 extend up to the twisting units 5 in the receiving position. The twisting units 5 remain in the same receiving position even for twisting multiple cables.

In the shown starting position of the grippers 8*a* and 8*b*, initially a first end of an individual conductor L (see FIG. 8 and FIG. 9) can be gripped by a gripper 8*a* closer to the twisting head 4, and then the gripper 8*a* can be displaced in the x-direction toward the twisting head 4. When the second end of the individual conductor L reaches the second gripper 8*b*, the second gripper 8*b* grips the individual conductor L in the region of the second end thereof.

Figure 8:
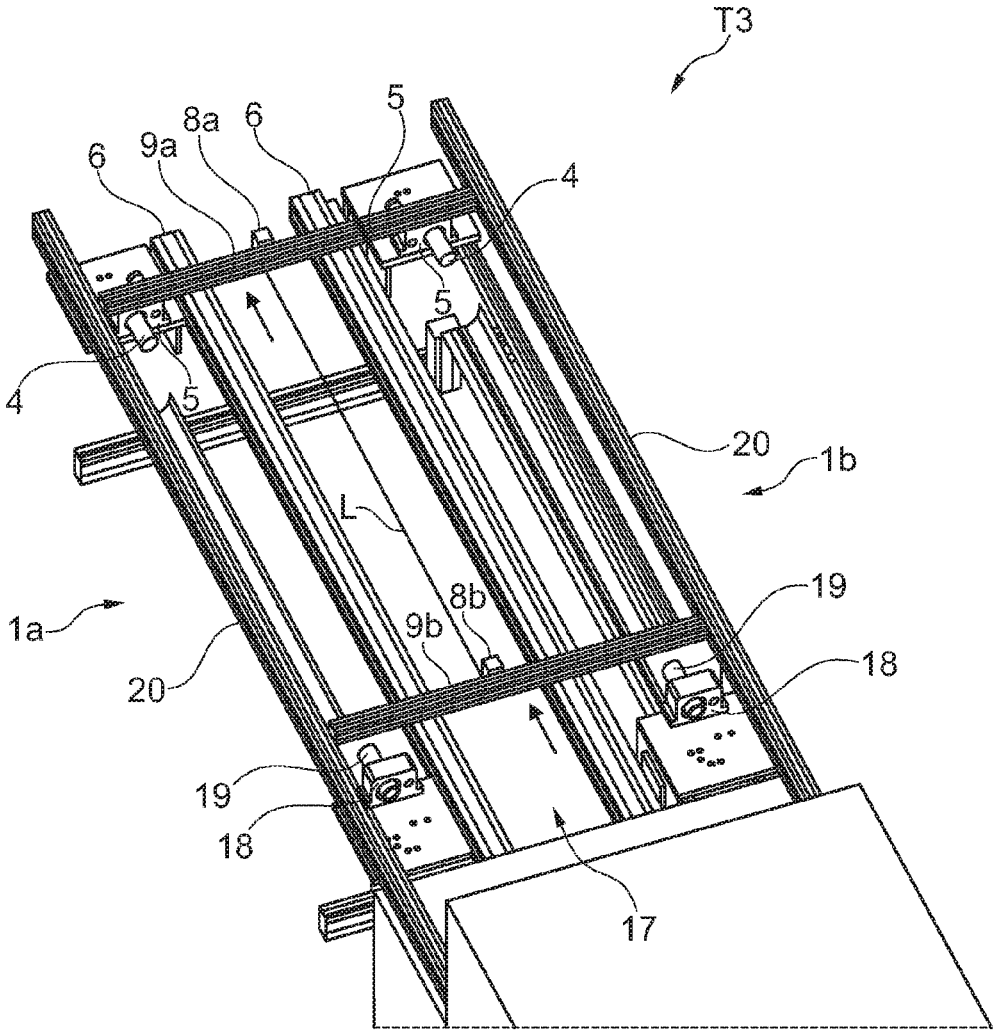
FIG. 8 shows a view from obliquely above onto a section of the tandem twisting system according to the third exemplary embodiment, including the loading device in a second position.

As depicted in FIG. 8, the two grippers 8*a* and 8*b*, which are arranged behind one another in the x-direction here, displace the individual conductor L so much in the x-direction that they are arranged laterally next to a section between the twisting head 4 and the untwisting head 19, which is still free.

Figure 9:
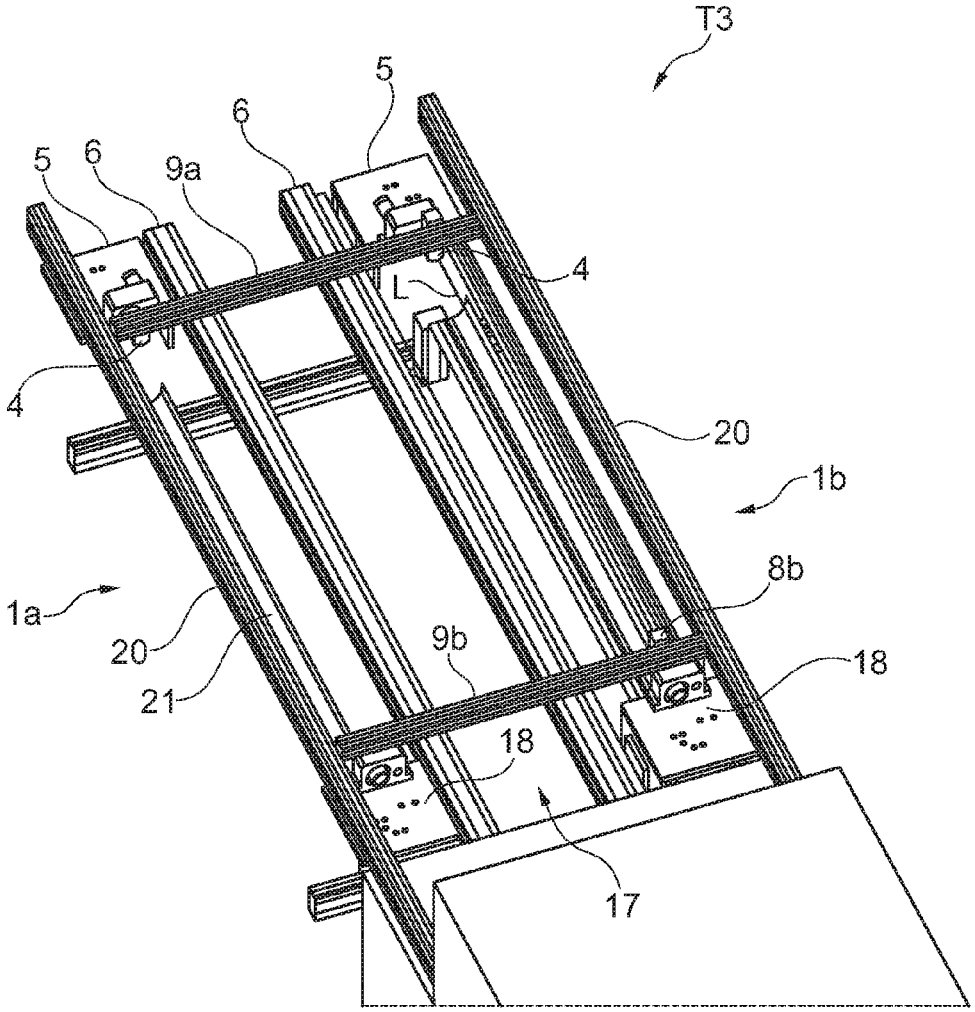
FIG. 9 shows a view from obliquely above onto a section of the tandem twisting system according to the third exemplary embodiment, including the loading device in a third position.

As further depicted in FIG. 9, the grippers 8*a* and 8*b* are displaced laterally or in the y-direction, following along the transverse rails 9*a* and 9*b*, so that they reach their respective receiving position in front of the twisting head 4 or in front of the untwisting head 19 and there, or from there, are introduced into the associated holders 12 of the twisting head 4 or of the untwisting head 19. The loading process may be repeated as described for the tandem twisting system T2, for example, by using a turret-like rotation of the twisting head 4 and of the untwisting head 19 at identical transfer positions of the grippers 8*a* and 8*b*, and the like.

Modifications of the disclosed embodiments are possible.

For example, after the loading of the twisting head 4, or the twisting head 4 and the untwisting head 19, has been completed and, in certain aspects, even before the actual twisting operation begins, further functional units may be introduced, for example, a lay length positioning unit or "twisting slide," a conductor stabilization unit, or a conductor support unit.

What is claimed is:

1. A system for twisting a plurality of conductors together, the system comprising:

a rotatable twisting head having multiple holders, where each holder is configured to hold at least one of the plurality of conductors, wherein the rotatable twisting head is configured to twist the plurality of conductors together into a single cable and configured to rotate the holders into a receiving position to receive the plurality of conductors;

a loading device configured to sequentially load each of the holders with a corresponding one of the plurality of conductors; and a rotatable untwisting head having multiple holders configured to hold the plurality of conductors for twisting into a single cable and having a free holder rotatable into a loading position, wherein the loading device is configured to move into a first transfer position for loading the twisting head, and the first transfer position is the same for each conductor in the plurality of conductors and further configured to move into a second transfer position for loading the untwisting head.

2. The system of claim 1, wherein the receiving position is the same for each conductor in the plurality of conductors.

3. The system of claim 1, wherein the second transfer position is the same for each conductor in the plurality of conductors.

4. The system of claim 1, wherein the loading device is further configured to displace two ends of the conductors simultaneously to the twisting head.

5. The system of claim 1, wherein the loading device is further configured to displace two ends of the conductors simultaneously to the untwisting head.

6. The system of claim 1, wherein the loading device is further configured to hold a first end of the conductors and to displace a second end of the conductors to the twisting head.

7. The system of claim 1, wherein the holders are further configured to receive the conductors at a plurality of depths with respect to each other.

8. The system of claim 1, wherein the loading device includes a cross slide table and at least one gripper configured to be displaced along the table and to grip and release one or more conductors.

9. The system of claim 8, wherein the cross slide table includes at least one longitudinal rail extending in a first direction, and at least one transverse rail extending in a second direction, wherein the second direction is perpendicular to the first direction.

10. The system of claim 9, wherein the at least one gripper is movable along the at least one longitudinal rail and movable along the at least one transverse rail.

11. The system of claim 1, wherein the twisting head includes at least two gripper jaws movable relative to an abutment of the twisting head and configured to press and fix one or more conductors against the abutment.

12. A tandem system for twisting a first plurality of conductors together and a second plurality of conductors together, comprising:

a first rotatable twisting head having multiple holders, where each holder is configured to hold at least one of the first plurality of conductors, wherein the rotatable twisting head is configured to twist the first plurality of conductors together into a single cable and configured to rotate the holders into a first receiving position to receive the first plurality of conductors;

a second rotatable twisting head having multiple holders, where each holder is configured to hold at least one of the second plurality of conductors, wherein the rotatable twisting head is configured to twist the second plurality of conductors together into a single cable and configured to rotate the holders into a second receiving position to receive the second plurality of conductors; and a shared loading device configured to sequentially load each of the holders of the first twisting head with a corresponding one of the first plurality of conductors and configured to, in tandem, sequentially load each of the holders of the second twisting head with a corresponding one of the second plurality of conductors, wherein the first and second twisting heads are in juxtaposition with the shared loading device interposed between the first and second twisting heads.

13. The tandem system of claim 12, wherein the shared loading device is further configured to move into a first transfer position for loading the first twisting head.

14. The tandem system of claim 13, wherein the first transfer position is the same for each conductor in the first plurality of conductors.

15. The tandem system of claim 13, wherein the shared loading device is further configured to move into a second transfer position for loading the second twisting head.

16. The tandem system of claim 15, wherein the second transfer position is the same for each conductor in the second plurality of conductors.

17. A method for loading a twisting head with a plurality of conductors, comprising:

placing, by using a loading device, a first conductor of the plurality of conductors into a transfer position;

introducing a first conductor of the plurality of conductors into a first free holder of the twisting head located in a receiving position;

rotating the twisting head such that a second free holder of the twisting head is placed in the receiving position;

placing a second conductor of the plurality of conductors into the transfer position by using the loading device; and introducing the second conductor into the second free holder of the twisting head.

18. The method of claim 17, further comprising:

rotating the twisting head such that a third free holder of the twisting head is placed in the receiving position;

placing a third conductor of the plurality of conductors into the transfer position using the loading device; and introducing the third conductor into the third free holder of the twisting head.

19. The method of claim 17, further comprising:

rotating the twisting head such that the first free holder of the twisting head is placed in the receiving position;

placing a third conductor of the plurality of conductors into the transfer position using the loading device; and introducing the third conductor into the first free holder of the twisting head.

* * * * *